US012297612B2

(12) United States Patent
Bichler et al.

(10) Patent No.: US 12,297,612 B2
(45) Date of Patent: May 13, 2025

(54) ROCKFALL BARRIER

(71) Applicant: Trumer Schutzbauten Ges.m.b.H, Oberndorf (AT)

(72) Inventors: Ahren Bichler, Sechelt (CA); Gernot Stelzer, Kuchl (AT)

(73) Assignee: TRUMER SCHUTZBAUTEN GES.M.B.H., Obeendorf (AT)

( * ) Notice: Subject to any disclaimer, the term of this patent is extended or adjusted under 35 U.S.C. 154(b) by 9 days.

(21) Appl. No.: 17/998,136

(22) PCT Filed: May 4, 2021

(86) PCT No.: PCT/EP2021/061738
§ 371 (c)(1),
(2) Date: Nov. 7, 2022

(87) PCT Pub. No.: WO2021/224267
PCT Pub. Date: Nov. 11, 2021

(65) Prior Publication Data

US 2023/0220636 A1 Jul. 13, 2023

(30) Foreign Application Priority Data

May 8, 2020 (EP) ..... 20173750

(51) Int. Cl.
*E01F 7/04* (2006.01)

(52) U.S. Cl.
CPC ..... *E01F 7/045* (2013.01)

(58) Field of Classification Search
CPC .. E01F 7/04; E01F 7/045; E04H 17/02; E04H 17/06; E04H 17/08; Y02A 10/23
USPC ..... 256/13.1, 32, 35
See application file for complete search history.

(56) References Cited

U.S. PATENT DOCUMENTS 8,807,535 B2 * 8/2014 Stelzer ..... E01F 7/045 256/35

FOREIGN PATENT DOCUMENTS

| | | | | |
|---|---|---|---|---|
| CN | 201908312 U | | 7/2011 | |
| DE | 102006013526 A1 | * | 8/2007 | ..... E01F 7/045 |
| EP | 1130166 A2 | * | 9/2001 | ..... E01F 7/045 |
| EP | 1500747 A1 | * | 1/2005 | ..... E01F 7/045 |
| EP | 2489785 B1 | | 10/2014 | |
| FR | 2899252 A1 | * | 10/2007 | ..... E01F 7/045 |
| FR | 3032463 B1 | * | 10/2021 | ..... E01F 7/045 |
| JP | 56138909 U | | 10/1981 | |

(Continued)

OTHER PUBLICATIONS

International Search Report and Written Opinion of the International Searching Authority from the European Patent Office, in PCT/EP2021/061738 dated Jul. 1, 2021, which is an international application to which this application claims priority.

*Primary Examiner* — Josh Skroupa
(74) *Attorney, Agent, or Firm* — Kolitch Romano Dascenzo Gates LLC

(57) ABSTRACT

A rockfall barrier for installation between an uphill side and a downhill side of a hill slope, with at least two guide devices for a net comprising an upper edge and a lower edge, and with an upper load-bearing rope, which guides the upper edge on the guide devices At least one middle rope is provided, which extends from an upper end point fixed to the upper load-bearing rope to a lower end point fixable at the hill slope.

17 Claims, 4 Drawing Sheets

(56) References Cited

FOREIGN PATENT DOCUMENTS

JP 2020111961 A * 7/2020 ..... Y02A 10/23

* cited by examiner

ROCKFALL BARRIER

FIELD

The present disclosure relates to a rockfall barrier.

INTRODUCTION

Such a rockfall barrier is known from EP 2 489 785 B1. The advantage of this rockfall barrier is to be seen in the fact that, on the one hand, it is possible to absorb high energy in the net and, on the other hand, it is also possible to transport the collected material from the support area to more easily accessible areas lying below the supports.

In the common rockfall barrier, the braking elements required to absorb the high energy are mostly located in the area of the supports. This makes maintenance and repair work more complex, especially when the common rockfall barrier is installed in terrain that is difficult to access.

SUMMARY

It is therefore the object of the present disclosure to provide a rockfall barrier of the type indicated in the preamble of claim 1, which is also suitable for absorbing high energy in the net, while at the same time facilitating maintenance and repair work, in particular at braking elements.

The rockfall barrier according to the present disclosure for installation between an uphill side and a downhill side of a hill slope comprises, at least two guide devices, a net with an upper and a lower edge, an upper load-bearing rope, which guides the upper edge of the net at the guide devices, and at least one middle rope. This middle rope extends from an upper end point fixed to the upper load-bearing rope to a lower end point, which is fixable at the hill slope.

Advantageously, the rockfall barrier according to the present disclosure can be provided with only one upper load-bearing rope. Alternatively, however, it is also possible to provide several such upper load-bearing ropes, in particular to bundle them, if this is necessary due to the loads to be expected. Furthermore, the rockfall barrier according to the present disclosure does not comprise any horizontal middle ropes, which would possibly retain blocks to be caught in the upper area or would again increase the maintenance and repair effort, since such horizontal middle ropes also have to be provided with braking elements.

In contrast, the arrangement of the middle rope of the rockfall barrier according to the present disclosure has the advantage that it can guide the collected stone or boulder downwards.

As a possible alternative, it can be provided that the at least one middle rope is also guided diagonally or obliquely through the hit field in the area of the net. For this purpose, the middle rope can be arranged from an upper end point fixed to the upper load-bearing rope to a lower end point fixed at the hill slope. Also in this embodiment, the at least one middle rope can be provided with a braking element fixable at the hill slope and arranged adjacent to the lower edge of the net.

The connection of the middle rope with the net can be formed by looping it through the net, or by abutting it on the hill facing side at the top or on the side facing away from the hill. In this case, the middle rope is preferably connected to the net via connecting elements such as shackles or sewing ropes.

Advantageously, the at least one middle rope is provided with a braking element fixable at the hill slope and arranged adjacent to the lower edge of the net.

This advantageously ensures not only that the collected material can be conveyed from the support area (area with supports) to more easily accessible areas below the supports, but also that the braking element is located in these more easily accessible areas, which considerably facilitates necessary maintenance and repair work, especially after an impact. The dependent claims relate to advantageous further developments of the present disclosure.

In another particularly preferred embodiment, the rockfall barrier according to the present disclosure comprises two middle ropes, which can each be provided with an associated braking element, which are arranged adjacent to the lower edge of the net.

For fixing the at least one middle rope, an anchor can be provided, which is fixable at the hill slope.

If several middle ropes, in particular two middle ropes, are provided, each of these middle ropes can be fixed with an associated anchor at the hill slope.

BRIEF DESCRIPTION OF THE DRAWINGS

Further details, features and advantages of the present disclosure will be apparent from the following description of embodiments based on the drawing.

DETAILED DESCRIPTION

Figure 1:
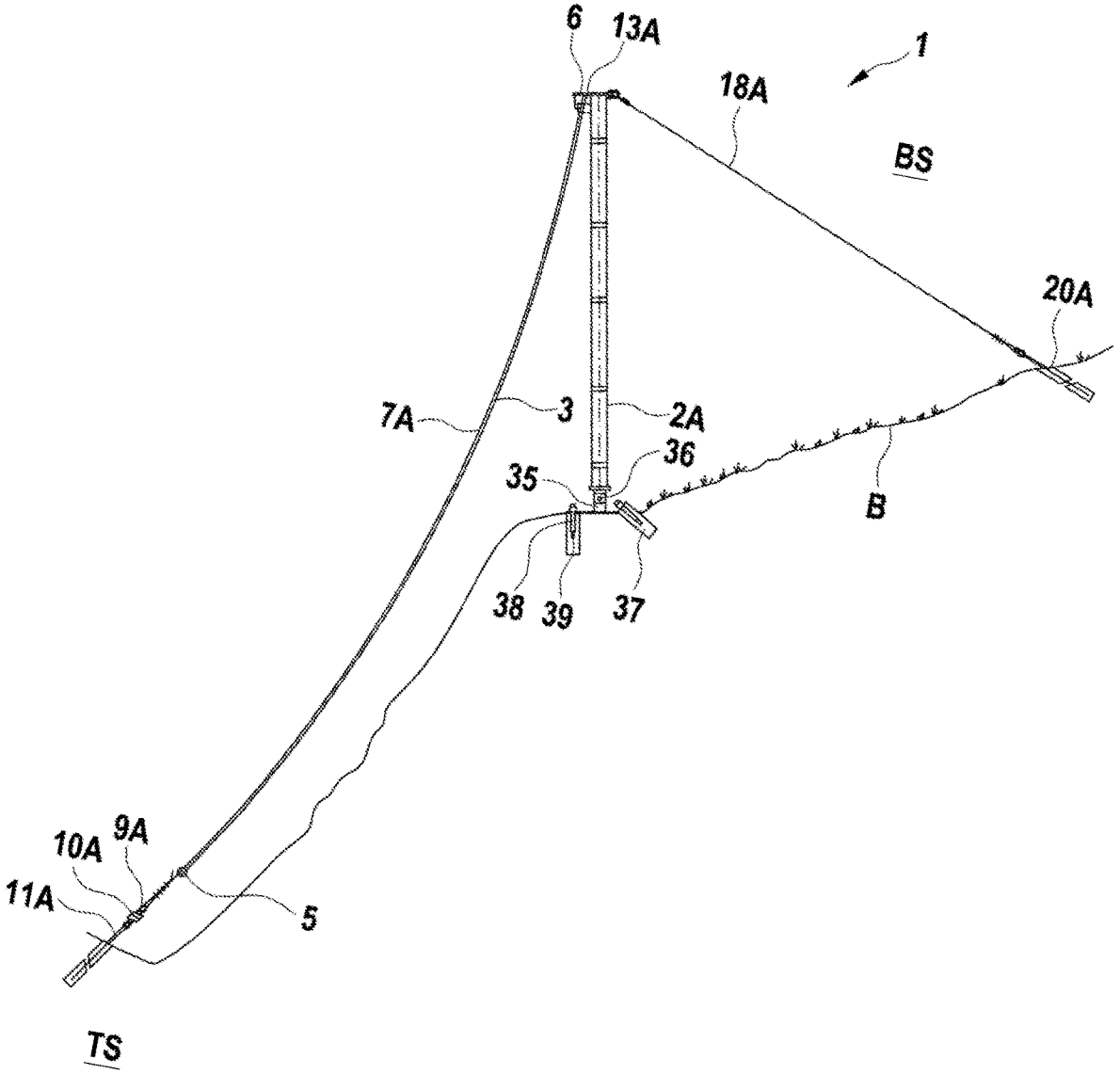
FIG. 1 shows a schematic, slightly simplified side view of a rockfall barrier according to the present disclosure.

FIG. 1 shows a rockfall barrier 1 for installation between an uphill side BS and a downhill side TS of a hill slope B.

Figure 2:
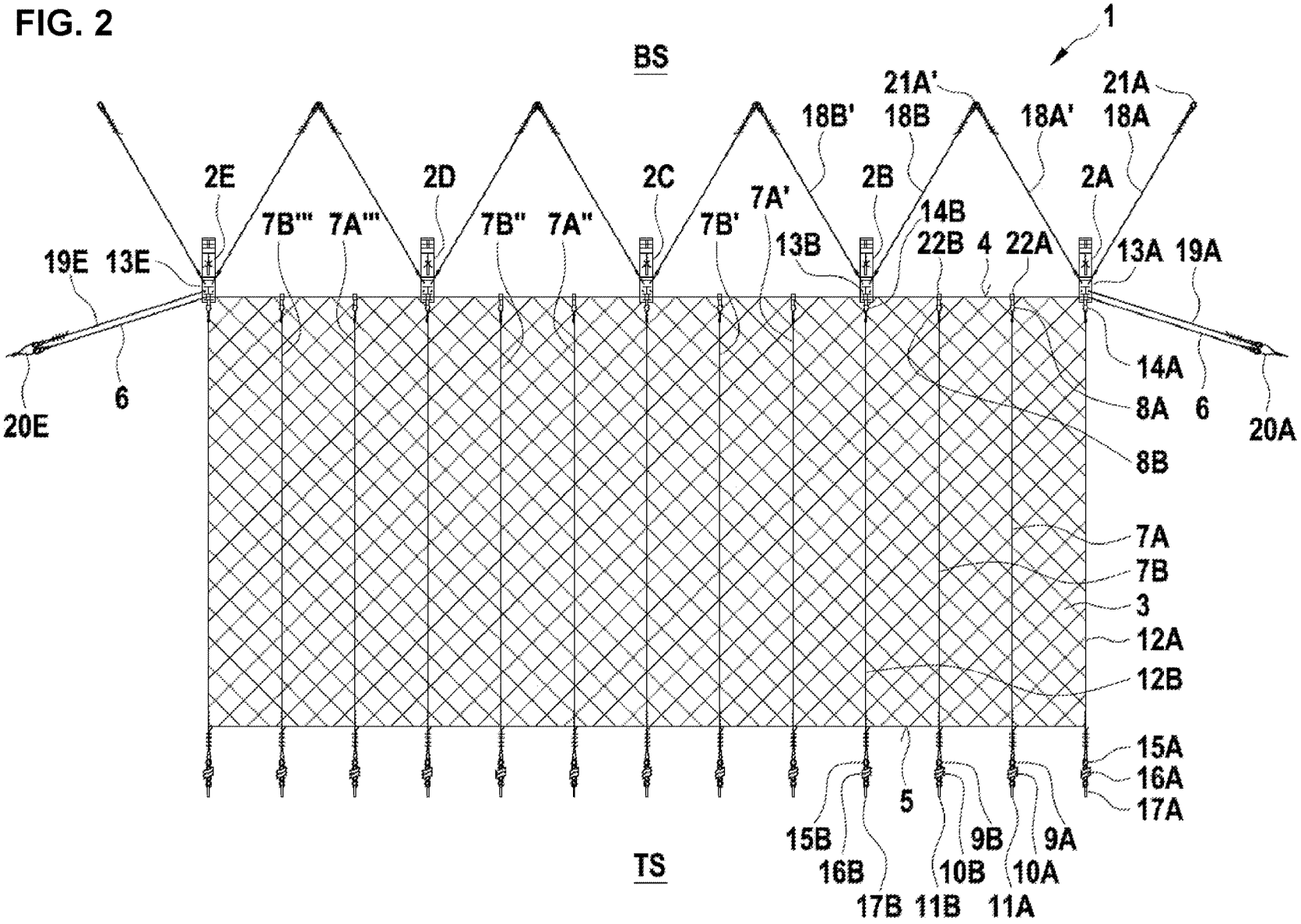
FIG. 2 shows a top view or a plan view of the rockfall barrier according to FIG. 1.

This rockfall barrier 1 comprises at least two guide devices, of which only one guide device 2A is visible due to the illustration chosen in FIG. 1. However, the illustration in FIG. 2 shows that in the example case shown in this figure, a total of five such guide devices can be provided in the form of supports 2A, 2B, 2C, 2D and 2E. However, in order to be able to tension a net 3, which is a further component of the rockfall barrier 1 according to the present disclosure, at least two guide devices or supports 2A and 2B must be provided. Of course, it is possible that more than five such guide devices or supports may be provided, depending on the size of the area to be protected by the rockfall barrier.

As an alternative to such supports, it is possible to tension the net 3, for example, in a terrain gully, in particular in the form of a stream or river bed, in which case no supports are required, as the net 3 can be fixed to the edges delimiting the terrain gully (channel-shaped terrain form).

Another alternative for supports could be two walls, especially in the form of ferroconcrete walls or similar, which are provided anyway, for example, on a mountain road for other purposes.

As can be seen from a combined view of FIGS. 1 and 2, the net 3 comprises an upper edge 4 and a lower edge 5, which extends at a corresponding distance from the upper edge 4 depending on the size of the net 3.

The rockfall barrier 1 according to the present disclosure further comprises an upper load-bearing rope 6, which guides the upper edge 4 on the at least two guide devices, in particular the five guide devices 2A to 2E provided according to FIG. 2.

According to the present disclosure, at least one middle rope 7A is also provided, which extends from an upper end point 8A fixed to the upper load-bearing rope 6 to a lower end point 9A fixable at the hill slope B.

FIG. 1 further illustrates that the rockfall barrier 1 according to the present disclosure further comprises at least one braking element 10A, which is arranged adjacent to the lower edge 5 of the net 3 and is fixable at the hill slope, for example, via an anchor 11A, wherein FIG. 1 shows the installation state of the rockfall barrier 1 according to the present disclosure, in which the fixing by the anchor 11A at the hill slope B is carried out at the downhill side.

A combined view of FIGS. 1 and 2 further illustrates that the support 2A is secured to the hill slope B by two hill side restraint ropes 18A, 18A' via two hill side anchors 21A, 21A'.

As FIG. 1 further shows, the support 2A comprises a column head 13A, through which the upper load-bearing rope 6 is guided.

At the lower end, the support 2A is provided with a bolt 36 with spring cotter pin and a bottom plate 35. The bottom plate 35 is fixed at the hill slope B by a tension pile 37, a micropile tube 38 and a compression pile 39.

As previously explained with reference to FIG. 2, at least two guide devices are required to tension the net 3, which in the particularly preferred embodiment shown in FIG. 2 are formed as supports 2A and 2B. As explained, however, in the example case five such supports 2A to 2E are provided, which are respectively arranged at a distance from each other. The construction, arrangement and securing or installation of these supports 2A to 2E is the same for each of the supports shown, so that in the following reference is made to supports 2A and 2B as representative of all supports 2A to 2E.

The support 2A is connected with a load-bearing rope 12A. This load-bearing rope comprises an upper end point 14A, which is fixed to the support 2A. The load-bearing rope 12A further comprises a lower end point 15A, which is connected with a braking element 16A and which is fixable at the hill slope B via an anchor 17A.

A corresponding arrangement comprises the support 2B, which can also be fixed at the hill slope B via a load-bearing rope 12B with upper end point 14B and lower end point 15B as well as braking element 16B and anchor 17B.

In the example, two middle ropes 7A and 7B extend between the load-bearing ropes 12A and 12B, which are called middle ropes, because they are arranged in a middle area between the load-bearing ropes 12A and 12B.

The two middle ropes 7A and 7B comprise upper end points 8A and 8B and lower end points 9A and 9B. The upper end points 8A and 8B are attached to the upper load-bearing rope 6 via rope connections 22A and 22B respectively. The rope connections 22A and 22B can, for example, be formed as T-shaped connections, which are preferably movable components.

The middle ropes 7A and 7B further comprise braking elements 10A and 10B arranged adjacent to the lower edge 5 of the net 3, to which the lower end points 9A and 9B are fixed. The fixing of the braking elements and thus the fixing of the lower end points 9A and 9B of the middle ropes 7A and 7B is carried out by anchors 11A and 11B.

Thus, all braking elements 10A, 10B of the middle ropes 7A, 7B and 16A as well as 16B of the load-bearing ropes 12A and 12B are arranged adjacent to the lower edge 5 of the net 3, wherein the lower edge 5, as FIG. 1 illustrates, is associated with an easily accessible area of the hill slope B, so that both stones or boulders, which have been transported into this easily accessible area by means of the middle ropes 7A and 7B can be removed easily and without danger from the net 3 and maintenance work, in particular repair work on the braking elements, can also be carried out easily and safely.

FIG. 2 also shows that the upper load-bearing rope 6 can be fixed at the sides of the two outermost supports 2A and 2E respectively at the hill slope B via side anchors 20A and 20E. Furthermore, a side bracing 19A and 19E is provided in the area of these outermost supports 2A and 2E respectively. Both the ends of the upper load-bearing rope 6 and the side bracings 19A and 19E are fixable via side anchors 20A and 20E at the hill slope B.

Should it be necessary due to particularly high expected energy, braking elements can also be provided in the area of these side anchors 20A and 20E.

The rope connections 22A and 22B can, as explained above, be either movable along the load-bearing rope axis of the upper load-bearing rope 6 or also formed in a fixed manner. As also explained previously, the particularly preferred embodiment shown in FIG. 2 comprises a total of five supports 2A to 2E.

Furthermore, middle ropes 7A', 7B' are provided between the load-bearing ropes associated with supports 2B and 2C, middle ropes 7A" and 7B" between the load-bearing ropes associated with supports 2C and 2D, and middle ropes 7A'" and 7B'" between the load-bearing ropes associated with supports 2D and 2E. With regard to their arrangement, extension and fixing, reference can be made to the above description of the middle ropes 7A and 7B, since in this respect both the supports 2A to 2E and the respective middle ropes are formed, arranged and fixed identically.

This also applies to the hill side restraint ropes, which have already been explained by means of the restraint ropes 18A, 18A' and 18B for the supports 2A and 2B as examples for all supports 2A to 2E.

Figure 3:
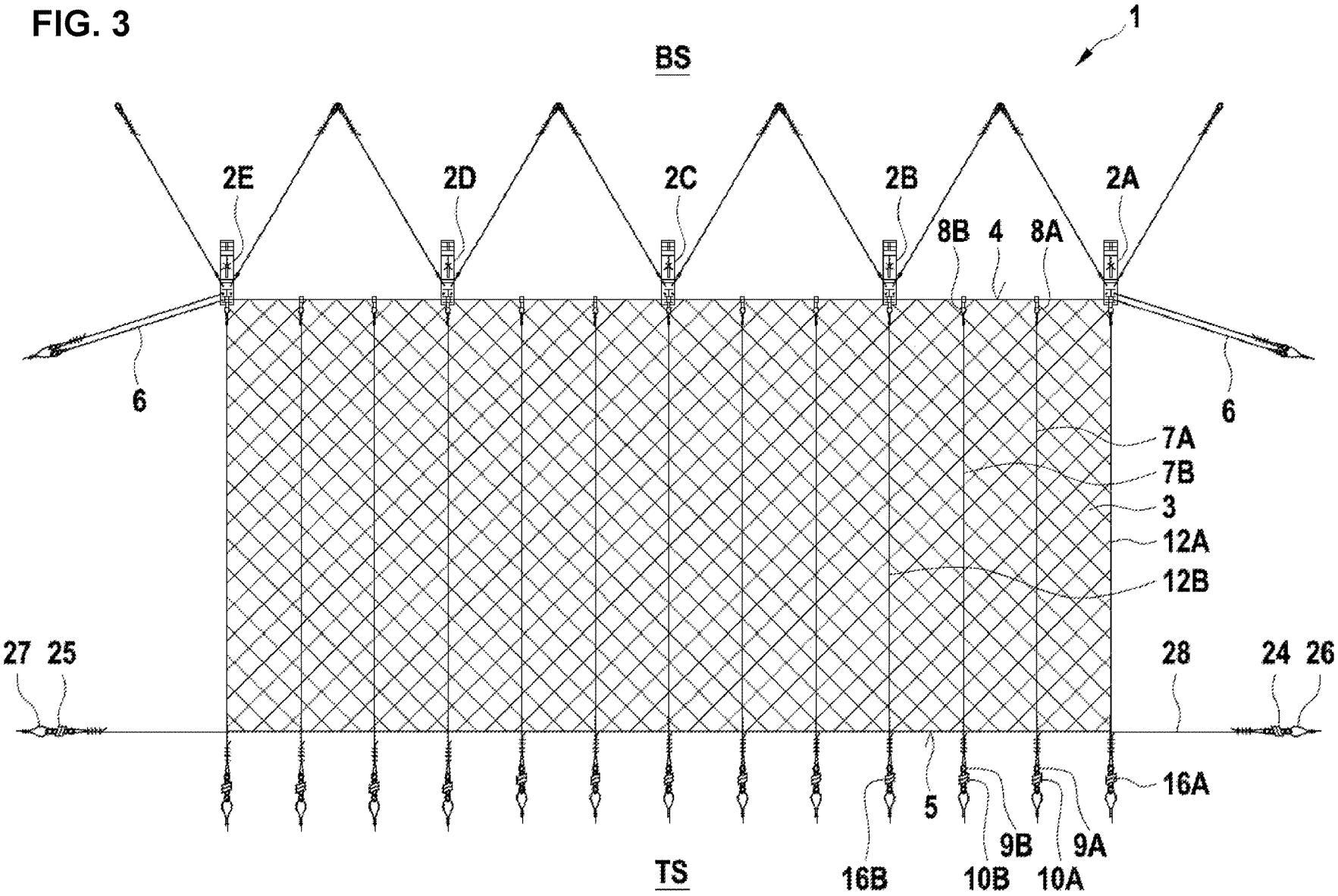
FIG. 3 shows a representation of a first variant of the rockfall barrier according to the present disclosure corresponding to FIG. 2.

The embodiment of the rockfall barrier 1 according to the present disclosure as shown in FIG. 3 differs from that shown in FIG. 2 only in the arrangement of a lower net edge rope 28, by which the lower edge 5 of the net 3 is guided. This lower net edge rope 28 extends through the entire lower edge 5 and is secured and tensioned on both sides of the net 3 via braking elements 24 or 25 and anchors 26 or 27 at the hill slope B. The upper load-bearing rope 6, the load-bearing ropes of the supports 2A to 2E, the middle ropes, and the lower net edge rope 28 are preferably looped through or threaded into the net 3.

With regard to all other components of the embodiment of the rockfall barrier 1 according to FIG. 3, reference can be made to the explanations on FIG. 2.

Figure 4:
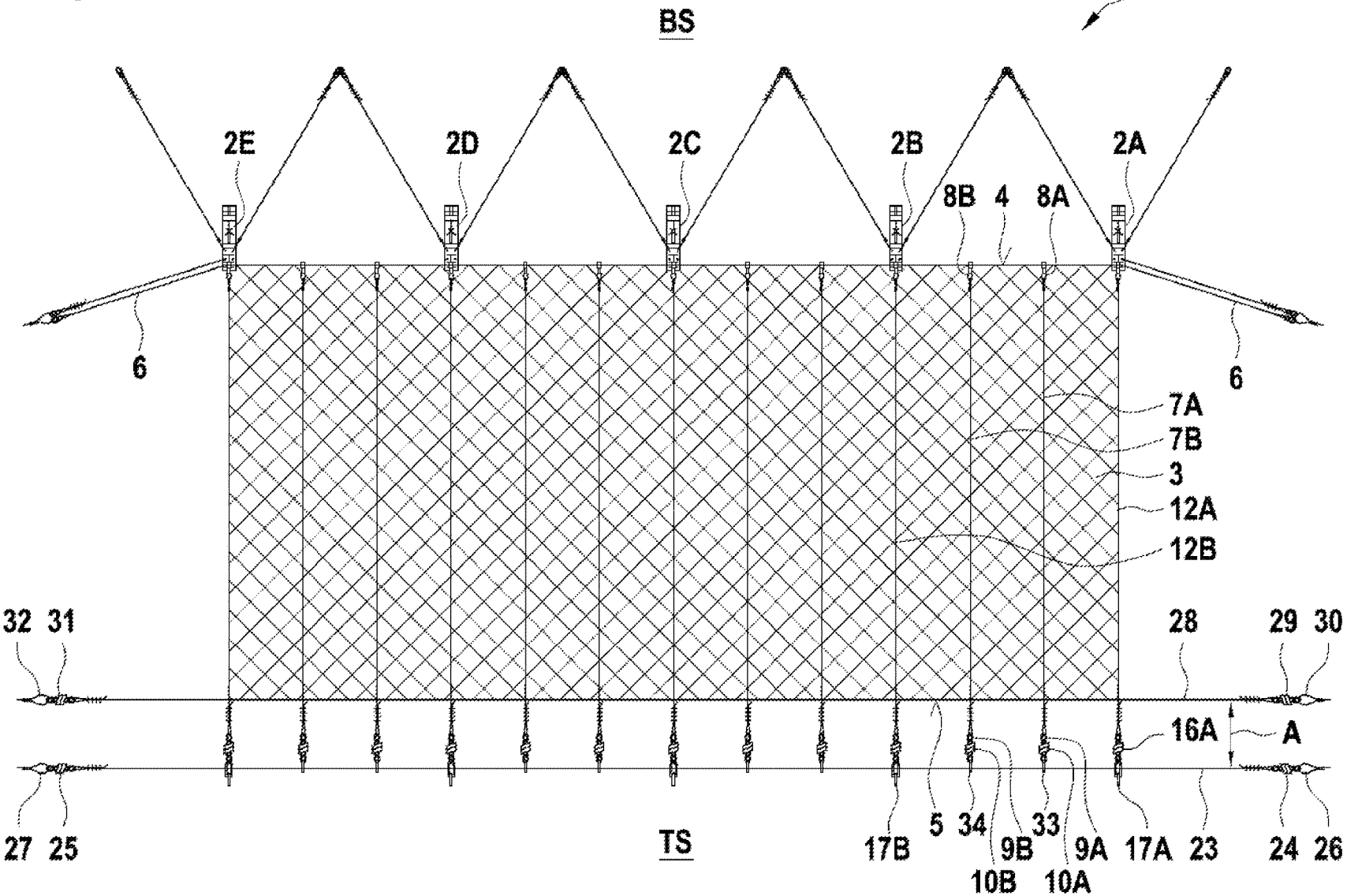
FIG. 4 shows a representation of a second variant of the rockfall barrier according to the present disclosure corresponding to FIGS. 2 and 3.

This also applies to the embodiment of the rockfall barrier 1 according to FIG. 4, in which, as in the embodiment according to FIG. 3, the lower edge 5 of the net 3 is guided via a net edge rope 28, which can be fixable on both sides of the net 3 via braking elements 29 and 31 as well as anchors 30 and 32 at the hill slope B. The lower load-bearing rope 23 of this embodiment is arranged at a distance A from the net edge rope 28 and is fixed to the hill slope B on both sides via braking elements 24 and 25 as well as anchors 26 and 27. As FIG. 4 shows, this has the advantage that only the load-bearing ropes 12A and 12B need to be fixed to the hill slope B via anchors 17A and 17B, while the middle ropes 7A and 7B can be fixed to the lower load-bearing rope 23 via rope guides 33 and 34. Preferably, this fixing can be formed movably along the axis of the lower load-bearing rope 23. It is also possible that a plurality of such load-bearing ropes are provided, for example combined as a bundle.

Furthermore, there is the advantage that the braking elements of the load-bearing ropes 12A and 12B as well as the middle ropes 7A and 7B can easily extend in the area created by the distance A, if this is necessary due to the impact of one or more boulders into the net 3.

As stated, reference may be made to the description of the preceding embodiments with respect to the construction of the arrangement and the fixing of the components of the rockfall barrier 1 as shown in FIG. 4.

In addition to the foregoing written disclosure of the present disclosure, explicit reference is hereby made to the graphic representation of the present disclosure in FIGS. 1 to 4.

REFERENCE SIGN LIST

1 rockfall barrier
2A to 2E guide devices/supports
3 net
4 upper edge
5 lower edge
6 upper load-bearing rope
7A, 7B middle rope
8A, 9A end points
10A, 10B, 16A, 16B, 24, 25, 29, 31 braking elements
11A, 11B, 17A, 17B, 20A, 20E, 26, 27, 30, 32 anchor
13A, 13B column heads
18A, 18N, 18B hill side restraint ropes
19A, 19B rope bracing
21A, 21N anchor of hill side restraint rope
22A, 22B rope connections
28 net edge rope
33, 34 rope guide elements
35 bottom plate
36 bolt with spring cotter pin
37 tension pile
38 micropile tube
39 pressure pile
A distance
B hill slope
BS uphill side
TS downhill side

The invention claimed is:

1. A rockfall barrier for installation between an uphill side and a downhill side of a hill slope, the rockfall barrier comprising:

at least two guide devices for a net having an upper edge and a lower edge, and an upper load-bearing rope configured to guide the upper edge at the guide devices, wherein at least one middle rope is provided, the at least one middle rope extending from an upper end point fixed at the upper load-bearing rope to a lower end point configured to be fixed to the hill slope, wherein each at least one middle rope is directly coupled to a respective braking element configured to be fixed to the hill slope and arranged adjacent to the lower edge of the net.

2. The rockfall barrier according to claim 1, wherein two of the middle ropes are provided.

3. The rockfall barrier according to claim 1, wherein the at least two guide devices are formed as supports arranged adjacent to each other.

4. The rockfall barrier according to claim 1, wherein an upper end point of an associated load-bearing rope is fixed at a fixing point of the respectively associated guide device, the load-bearing rope extends from the upper end point to a lower end point configured to be fixed at the hill slope, and wherein associated braking elements are respectively arranged adjacent to the lower edge of the net.

5. The rockfall barrier according to claim 1, wherein the at least two guide devices are configured to be fixed at the hill slope via hill side restraining ropes engaging at the respective fixing points.

6. The rockfall barrier according to claim 1, wherein outermost guide devices of the at least two guide devices are configured to be fixed at the hill slope via a rope bracing engaging the respective fixing point.

7. The rockfall barrier according to claim 1, wherein the upper end point of the middle rope is attached to the upper load-bearing rope via a rope connection.

8. The rockfall barrier according to claim 7, wherein the rope connections are formed as T-shaped connections.

9. The rockfall barrier according to claim 7, wherein the rope connections are formed as movable components.

10. The rockfall barrier according to claim 1, wherein the lower edge of the net is guided via a lower net edge rope.

11. The rockfall barrier according to claim 10, wherein the lower net edge rope extends at least approximately parallel to the upper load-bearing rope in the region of the net.

12. The rockfall barrier according to claim 10, wherein the lower net edge rope is configured to be fixed at the hill slope via at least one braking element and at each rope end via an associated side anchor.

13. The rockfall barrier according to claim 10, wherein a lower load-bearing rope extends at a distance from the net edge rope and that the middle rope or ropes is/are guided at the lower load-bearing rope via rope guide elements.

14. The rockfall barrier according to claim 1, wherein an anchor is provided respectively for fixing the middle rope or the middle ropes at the hill slope.

15. The rockfall barrier of claim 1, wherein each of the braking elements is disposed in line with a long axis of the respective middle rope.

16. The rockfall barrier of claim 1, wherein the upper edge of the net is configured to be disposed uphill with respect to the lower edge of the net.

17. A rockfall barrier, comprising:

a net having an upper edge disposed at an uphill side of a hill slope and a lower edge disposed at a downhill side of the hill slope;

at least two supports configured to guide the net; and an upper load-bearing rope guiding the upper edge at the at least two supports;

wherein at least one middle rope extends from an upper end point fixed at the upper load-bearing rope to a lower end point fixed to the hill slope;

wherein each at least one middle rope is directly coupled to a respective braking element fixed to the hill slope and arranged adjacent to the lower edge of the net.

* * * * *